United States Patent [19]

Mukoh et al.

[11] Patent Number: 4,990,418

[45] Date of Patent: Feb. 5, 1991

[54] ELECTROPHOTOGRAPHIC PHOTORECEPTOR AND METHOD OF PRODUCING THE SAME

[75] Inventors: Akio Mukoh; Mitsuoshi Shoji; Shigeo Suzuki; Takayuki Nakakawaji; Yutaka Ito; Shigeki Komatsuzaki; Ryuichi Shimizu; Hiroyoshi Kokaku; Tsuneaki Kawanishi; Atsushi Kakuta, all of Ibaraki, Japan

[73] Assignee: Hitachi, Ltd., Tokyo, Japan

[21] Appl. No.: 362,047

[22] Filed: Jun. 6, 1989

[30] Foreign Application Priority Data

Jun. 7, 1988 [JP] Japan ..... 63-138356

[51] Int. Cl.[5] ..... G03G 15/00

[52] U.S. Cl. ..... 430/56

[58] Field of Search ..... 430/56

[56] References Cited

FOREIGN PATENT DOCUMENTS 0189559 8/1986 Japan ..... 430/56

3027599 2/1988 Japan .

3316057 12/1988 Japan ..... 430/56

OTHER PUBLICATIONS

A. R. Marat, Release Agent in Photoreceptor Matrix, Xerox Disclosure Journal, vol. 1, No. 7, Jul. 1976, p. 27.

*Primary Examiner*—Marion C. McCamish

*Assistant Examiner*—S. Crossan

*Attorney, Agent, or Firm*—Antonelli, Terry, Stout & Kraus

[57] ABSTRACT

Disclosed is an electrophotographic photoreceptor in which an organic lubricant is provided on the surface of an organic photoconductive layer or on a protective layer formed on the organic photoconductive layer. Elements of the organic lubricant are partly exposed from the surface of the organic photoconductive layer or the protective layer while the remainder portions of the elements are embedded or fixed by chemical reaction in the surface region of the photoconductive layer or the protective layer so that the exposed portions of the elements of the organic lubricant provides a lubricating surface layer. The lubricating surface layer supresses wear of the photoreceptor thereby enabling the photosensitive layer to withstand a long repeated use without impairing electrophotographic characteristics.

12 Claims, 2 Drawing Sheets

ELECTROPHOTOGRAPHIC PHOTORECEPTOR AND METHOD OF PRODUCING THE SAME

BACKGROUND OF THE INVENTION

1. Field of the Invention

The present invention relates to an electrophotographic photoreceptor. The invention also is concerned with a method of producing the electrophotographic photoreceptor.

2. Description of the Prior Art

Various organic and inorganic electrophotographic photosensitive materials have been proposed, among which a dual-layer type photoreceptor having a charge generating layer and a charge transport layer is becoming a matter of concern as a photoreceptor having high photosensitivity. In this type of photoreceptor, the charge generating layer is made of a charge generating compound such as a phthalocyanine pigment-type organic compound as disclosed in Japanese Patent Unexamined Publication No. 59-15253 or inorganic compounds of tellurium-arsenic-selenium alloy type as disclosed in Japanese Patent Unexamined Publication No. 50-15137, as well as various other known compounds. On the other hand, various compounds are usable as the charge-transport substance, such as compounds of of poly-N-vinylcarbazole as shown in Japanese Patent Unexamined Publication No. 52-77730 or of pyrazoline derivative type as disclosed in Japanese Patent Unexamined Publication No. 49-105537. These charge generating and charge transport compounds have been actually put into practical use in photoreceptors.

Meanwhile, a high-speed electrophotographic printers making use of a laser beam have been put into practical use. This type of printer is capable of performing printing at a high speed, while reducing the size of the light source unit and, hence, the size of the whole printer, particularly when a laser diode is used as the light source. It is also to be noted that organic photoreceptors are disposable by users themselves.

The known organic photoreceptors, on the other hand, has weak durability to abrasion as compared with inorganic photosensitive materials In consequence, the photoconductive layer is worn down to reduce the thickness thereof, so that the electrophotographic characteristics cannot have a long life. In order to overcome this problem, it has been proposed to form a protective film on the surface of the photoreceptor to protect it from mechanical damaging force For instance, Japanese Patent Unexamined Publication No. 58-83857 discloses a photoreceptor in which a selenium photosensitive layer is covered by a protective layer made of an electron donor and a binder. In this photoreceptor, a polycarbonate resin, polyester resin or a polyurethane resin is used as the binder used in the protective layer. Japanese Patent Unexamined Publication Nos. 61-22345 and 61-27550 propose photoreceptors having protective layers made of alkylether melamine formaldehyde. The protective layers of this material, however, tend to increase the level of the residual potential.

In use, a corona discharge makes the surface of the photosensitive material to cause the surface thereof to hold electric charges. Therefore, the photoreceptor, particularly when it is of organic type, tends to exhibit a degradation (oxidation) at the surface thereof during long use, increasing a tendency for the surface to be wetted with moisture. The wetted surface of the organic photosensitive material tends to allow an easy leakage of electric charges, resulting in a lowered resolution of printed images and other defects.

Photoreceptors using fluorine compounds are also known. For instance, Japanese Patent Unexamined Publication No. 62-206559 discloses an electrophotographic photoreceptor having a surface layer containing a fluorine oligomer compound. Japanese Patent Unexamined Publication No. 55-7762 discloses a photoreceptor made of a material containing a fluorine-containing compound. Japanese Patent Unexamined Publication No. 61-95358 discloses an image forming member provided with a resin layer containing fluorine polymer. Japanese Patent Unexamined Publication No. 58-23031 discloses an image carrier containing a surfactant having long-chain fluorinated alkyl group. An image carrier having a surface layer made of a material including a fluorine-containing silane coupling agent is proposed in Japanese Patent Unexamined Publication No. 61-205950.

The known organic electrophotographic photoreceptors mentioned above generally exhibit inferior wear-resistance characteristics due to small surface hardness as compared with inorganic photosensitive materials. In order to overcome this problem, Japanese Patent Unexamined Publication Nos. 58-83857, 61-22345 and 61-27550 propose to use resins having high levels of surface hardness. Such a countermeasure, however, is still unsatisfactory.

Another problem encountered with the known organic photoreceptors is that surfaces of these materials tend to be wetted due to absorption of water as a result of deterioration (oxidation) of the surfaces caused by a corona discharge during the use, with the result that the resolution of the print image is lowered.

Known photoreceptors containing fluoride component also are still unsatisfactory.

Arts shown in Japanese Patent unexamined Publication Nos. 62-206559 and 61-95358 cannot provide required strength of the coating layer because the mechanical strength of the organic coating layer is lowered as a result of use of a fluorine compound as the material of the binder of the organic coating material.

Arts shown in Japanese Patent Unexamined Publication Nos. 55-7762, 58-23031 and 61-205950 cannot provide sufficient lubrication effect because the fluorine compounds used therein are composed of perfluoroalkyl groups having short fluorine chains.

SUMMARY OF THE INVENTION

Accordingly, an object of the present invention is to provide an organic electrophotographic photosensitive material which can simultaneously meet both the demands for large wear-resistance and high resolution, as well as an electrophotographic apparatus which makes use of such a photoreceptor.

Another object of the present invention is to provide a simple method for producing the above-mentioned organic electrophotographic photoreceptor.

To these ends, according to the present invention, there is provided an electrophotographic photoreceptor comprising: a conductive substrate; an organic photoconductive layer formed on the conductive substrate; and an organic lubricant a portion of which being embedded in or fixed by chemical reaction to the surface region of the organic photoconductive layer while the remainder portion is exposed from the surface of the photoconductive layer, wherein at least the exposed remainder portion having a lubricating characteristics so as to provide a lubricant layer. The organic photoconductive layer may be formed directly on the conductive substrate or indirectly through the intermediary of another member According to another aspect of the invention, there is provided an electrophotographic photoreceptor comprising: a conductive substrate; an organic photoconductive layer formed on the conductive substrate; an organic protective layer covering the organic photoconductive layer; and an organic lubricant a portion of which being embedded in or fixed by reaction to the surface region of the organic photoconductive layer while the remainder portion is exposed from the surface of the photoconductive layer, wherein at least the exposed remainder portion having a lubricating characteristics so as to provide a lubricant layer. The organic photoconductive layer may be formed directly on the conductive substrate or indirectly through the intermediary of another member According to still another aspect of the present invention there is provided an electrophotographic apparatus comprising: an electrophotographic photoreceptor including a conductive substrate, an organic photoconductive layer formed on the conductive carrier, and an organic lubricant a portion of which embedded in or fixed by chemical reaction to the surface region of the organic photoconductive layer while the remainder portion is exposed from the surface of the photoconductive layer, wherein at least the exposed remainder portion having a lubricating characteristics so as to provide a lubricant layer; a corona discharging part for depositing charges to the photoreceptor; an light-exposing part in which the photoreceptor is exposed to information to be recorded thereby forming an electrostatic latent image; a developing part in which a toner is electrostatically deposited to the photoreceptor thereby developing the recorded image; a transferring part in which the toner image is transferred to a recording paper; a fixing part in which the transferred toner image is fixed; a charge-removing part in which charges are removed from the photoreceptor; and a cleaning part in which the residual toner is removed from the photoreceptor.

According to a further aspect of the present invention, there is provided a method of producing an electrophotographic photoreceptor comprising the steps of: forming a mixture of an organic photoconductive layer material, an organic lubricant which has a portion including groups soluble in the organic photoconductive layer material and the remainder portion including groups insoluble in the organic photoconductive layer material; coating a conductive substrate with the liquid mixture; and drying the coating layer so that the elements of the organic lubricant stand densely and closely together on the surface of the organic photoreceptor to such that the groups insoluble in the organic photosensitive layer material are exposed on the surface of the organic photoconductive layer while the groups soluble in the organic photosensitive layer material are embedded in the surface region of the organic photoconductive layer.

Electrophotographic photoreceptors, particularly organic ones, exhibit deterioration during repeated use. The deterioration is caused not only by oxidation degradation which takes place as a result of corona discharge but also by mechanical damages and wear caused by friction between the paper (transfer paper) and/or developing agent. In particular, in case of a double-layered photoreceptors, the charge transport layer, which is exposed to the outside, is mainly composed of an charge transporting material and a binder and, hence, exhibits an extremely small surface hardness as compared with inorganic photoreceptors. Wear and mechanical damage during long use are therefore unavoidable, thus constituting a major factor of degradation of the photoreceptors. It has been known to provide a protective layer mainly composed of a resin covering the photoconductive layer thereby to improve the surface hardness. This countermeasure, however, is not preferred because the protective layer tends to allow generation of high residual potential which is an unfavorable factor of electrophotographic characteristic. The protective layer also causes a secular change of the photoreceptor with the result that the resolution is rapidly degraded.

In view of the disadvantages of the known electrophotographic photoreceptors, the present invention proposes an electrophotographic organic photoreceptor containing an organic lubricant which has an anchoring function such that a portion of the lubricant is embedded in the surface region of an organic photoconductive layer while the other portion is exposed, thereby improving wear-resistance and anti-wetting characteristics of the photoreceptor. Typical example of such a lubricant contains fluorine compound groups the skeleton of which is composed of perfluoropolyoxyalkyl groups or perfluoropolyoxyalkylene groups. In a preferred form of the invention, the organic lubricant has a structure in which fluorine compound groups the skeleton of which is composed of perfluoropolyoxyalkyl groups or perfluoropolyoxyalkylene groups and groups containing no fluorine are bonded. The perfluoropolyoxyalkyl groups or perfluoropolyoxyalkylene groups which provide the lubrication effect are precipitated on the surface of the organic photoconductive layer and do not permeate into the photoconductive layer, so that these groups do not impair the mechanical strength. On the other hand, the groups which do not contain fluorine are embedded and fixed in the surface region of the organic photoconductive layer. It is thus possible to obtain a highly reliable electrophotographic organic photoreceptor.

The inventors also has found that the above-described lubricating structure on the organic photoreceptor can easily be obtained by preparing a mixture liquid composed of the material of the outermost portion of the organic photoconductive layer and the above-mentioned liquid lubricant, e.g., the organic lubricant containing fluorine compound groups the skeleton of which is composed of perfluoropolyoxyalkyl groups or perfluoropolyoxyalkylene groups, and then applying the mixture liquid directly or indirectly to the surface of the organic photoreceptor.

A typical example of the lubricant used in the present invention has a structure in which fluorine compound groups the skeleton of which is composed of perfluoropolyoxyalkyl groups or perfluoropolyoxyalkylene groups and groups containing no fluorine are bonded, and can be expressed by the following general formula

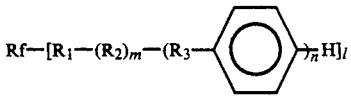

where, Rf represents a fluorine compound group having a skeleton composed of perfluoropolyoxyalkyl group or perfluoropolyoxyalkylene, $R_1$ represents a direct bond, —$CH_2$— group, —CO— group or —CONH—group, $R_2$ represents oxyalkylene group having a carbon number of 2 or 3, $R_3$ represents a direct bond, —O—group, —COO-group, —CONH-group, —NHCO— group, —$OC_pH_2p$-group (p being an integer which is 1 or 2) or —$C(CH_3)_2$-group, $R_3$ being changeable in each repetition, m represents 0 or a positive integer, n represents an integer which is 1 or greater, and l represents an integer which is 1 or 2.

Typically, the fluorine compound groups the skeleton of which is composed of perfluoropolyoxyalkyl groups or perfluoropolyoxyalkylene groups are monovalent or bivalent groups expressed by the following general formula:

$F(C_3F_6—O)_x$ or
$F(C_3F_6—O)_x\ C_2F_4$— or
$F(C_3F_6—O)_x$, $(F(C_3F_6—O)_x\ C_2F_4$—, F $[(C_3F_6—O)_x(CF_2—O)_y\ (CF_2)_z]$
and $[(C_2F_4—O)_y\ (CF_2—O)_z\ (CF_2)]$ where, x, y and z represents integers of 1 or greater. Preferably, x is 5 or greater, y is 10 to 25 and z is 10 to 56.

For example, a material produced and sold by du Pont Co., Ltd. under the commercial name of KRYTOX 143 an materials produced and sold by Montefluos under commercial names of FOMBLIN Y and FOMBLIN Z are usable as the groups containing fluorine compound.

In such a case, the lubricant having a structure in which perfluoropolyoxyalkyl groups or perfluoropolyoxyalkylene groups and groups containing no fluorine are bonded typically has the following construction:

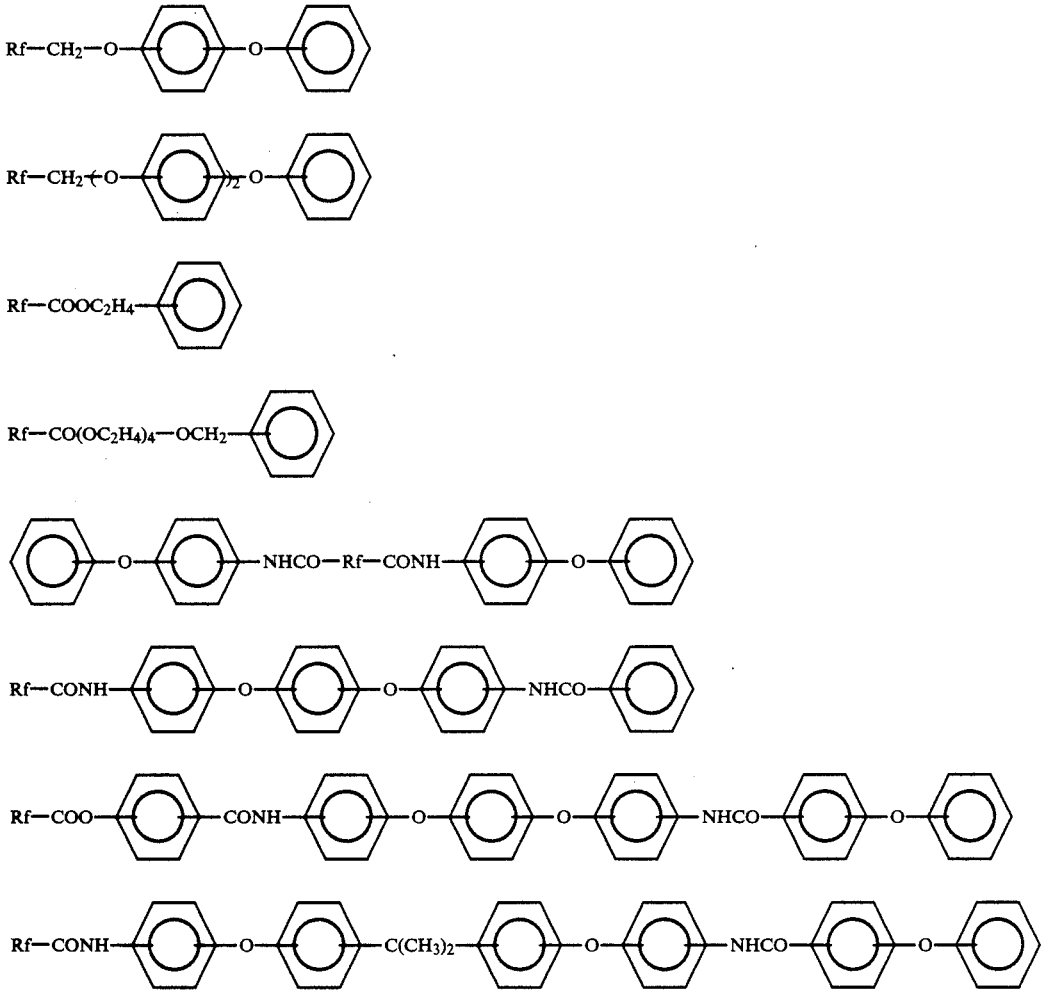

where, $R_f$ represents a fluorine compound groups the skeleton of which is composed of perfluoropolyoxyalkyl groups or perfluoropolyoxyalkylene groups.

The lubricant also may be an organic lubricant contains fluorine groups expressed by the following general formula $$Rf—R_1—R_2—Si(R_3)m$$

where, Rf represents a perfluoropolyoxyalkyl group or a perfluoropolyoxyalkylene group, $R_1$ represents amide group, carboxyl group or methyloxylene group, $R_2$ represents alkylene group having a carbon number of 2 to 4, $R_3$ represents oxyalkyl group having a carbon number of 1 to 3 and m represents a number of 1 to 3.

When the photoreceptor is of a double-layered type as in the case of the present invention, the charge generating material from which the charge generating layer is made can have a wide selection. For instance, the following materials are usable as the charge generating material independently or in the form of a mixture of two or more thereof: phthalocyanine pigments such as metal phthalocyanines and metal-free phthalocyanine, anthraquinone pigments, indigoid pigments, quinacridone pigments, perylene pigments, multi-ring quinone pigments, squaric acid derivatives, monoazo and disazo pigments and other known materials.

Examples of the charge transport materials used as the material of the charge transport layer may be selected from the following group: oxadiazole, triazole, imidazolone, oxazole, pyrazoline, imidazole, imidazolidine, benzothiazole, benzoxazole, triphenylamine, hydrazone and derivatives of these compounds. These compounds may be used independently or two or more of these compounds may be used together.

Although not exclusive, the binder used in the present invention is preferably a resin which is soluble in the charge transport material.

It is also preferred that the conductive substrate used in the present invention has a conductive layer of a volumetric resistivity of not higher than $10^{10}$ Ωcm, Examples of the materials of such a conductive layer are: a sheet with a coating of a metal such as aluminum, an alloy of aluminum and another or other metals, iron, lead and copper; a sheet coated with a conductive compound such as tin oxide, indium oxide, copper iodide and chromium oxide; a sheet of a conductive plastics; and a sheet of a plastics, paper or glass which is rendered conductive by evaporation or spattering.

The substrate can have a drum-like or a sheet-like form, as well as any other suitable form.

A description will be given of a typical example of the method for forming the charge generating layer and a charge transport layer on a conductive substrate. As the first step, a coating liquid of a charge generating material is prepared by mixing the charge generating material with an organic solvent which can well disperse the charge generating material and which can well dissolve resins and additives used as required, and sufficiently blending the mixture. Examples of such organic solvent are tetrahydrofuran, ethyl acetate, acetone, methyl ethyl ketone and halides of hydrocarbon. The thus prepared coating liquid is applied to a conductive substrate by dipping the latter in the coating liquid or by dripping the coating liquid onto the conductive substrate followed by spreading by means of a bar coater, a roll coater or an applicator. Then, heat or light rays are applied so as to set the coating resin by drying or cross-linking. The coating liquid may contain a binder such as a known three-dimensional setting type binder or a thermoplastic binder. The charge transport layer may be formed, for example, by the following process. As the first step, a coating liquid of the charge transport material is prepared by mixing and blending a charge transport material in an organic solvent together with a known adhesive binder, and applying the coating liquid on the charge generating layer, thereby forming a charge transport layer. The lubricant containing groups the skeleton of which is composed of perfluoropolyoxyalkyl groups or perfluoropolyoxyalkylene groups may can be added simply by being mixed with the coating liquid of the charge transportation layer. As in the case of the charge generating layer, the coating liquid of the charge transport material is applied by means of a bar coater, roll coater or an applicator, as well as by spreading or dipping, followed by setting through drying or cross-linking by application of heat or light rays, whereby a lubrication layer is formed on the surface of the charge transport layer.

The electrophotographic photoreceptor of the present invention has fluorine compound groups the skeleton of which is composed of perfluoropolyoxyalkyl groups or perfluoropolyoxyalkylene groups, the elements of the fluorine compound groups being fixed to the surface of the photoreceptor to stand closely together. The lubrication layer has an extremely small thickness of 5 nm or less so that it does never adversely affect the electrophotographic characteristics. In addition, the lubrication layer exhibits a superior effect in preventing wetting with water, as well as high lubrication effect.

Thus, according to one aspect of the present invention, there is provided a photoconductive photoreceptor formed directly on a conductive substrate or indirectly through an intermediary of another material, wherein a coating liquid, which contains a lubricant having a structure in which perfluoropolyoxyalkyl groups or perfluoropolyoxyalkylene groups are bonded to groups containing no fluorine, is mixed with the material constituting the outermost layer of the organic photoconductive material. In the photoreceptor thus formed, perfluoropolyoxyalkyl groups or perfluoropolyoxyalkylene groups which provide the lubrication effect are selectively precipitated on the surface of the organic photoconductive layer, whereas the group which do not contain fluorine are oriented and fixed in an organic photoconductive layer. The concentration of the perfluoropolyoxyalkyl groups or perfluoropolyoxyalkylene groups precipitating on the surface varies depending on the density of the binder or the density of the lubricant. The precipitated lubricant layer, when formed under the optimum conditions, exhibit a fluorine surface coverage on the organic photoconductive layer of a value which is as high as 9.5/10 of that exhibited by polytetrafluoroethylene (PTFE), as well as a high strength which is ¾ in terms of ratio to that of PTFE, as measured by fluorine element strength analysis by XPS. It is therefore possible to obtains an electrophotographic photoreceptor having superior lubrication performance, as well as high resistance to wetting with water.

DESCRIPTION OF THE PREFERRED EMBODIMENTS

Figure 1:
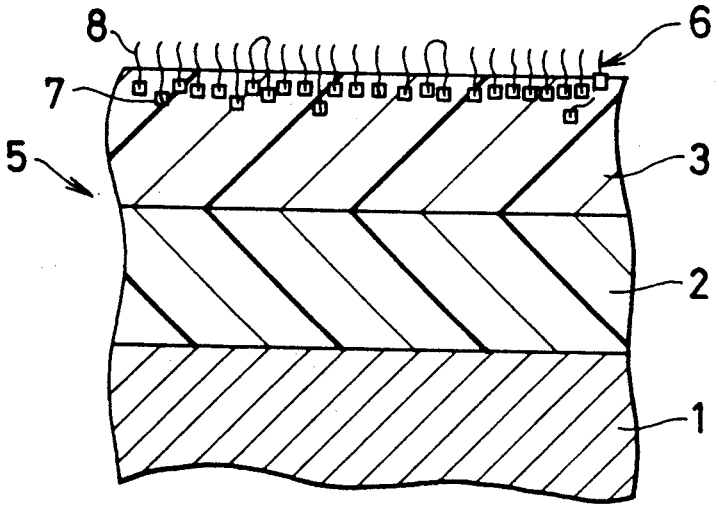
FIG. 1 is a schematic cross-sectional view of an embodiment of the electrophotographic photoreceptor of the present invention.

The photoelectric photoreceptor of the present invention can have, for example, a construction as shown in FIG. 1.

TABLE 1

| Lubricant No. | STRUCTURES OF LUBRICANTS |
|---|---|
| 1 | 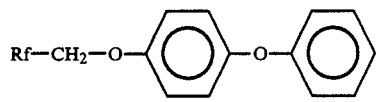 |
| 2 | 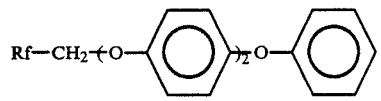 |
| 3 | 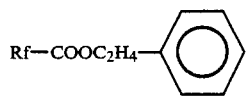 |
| 4 | 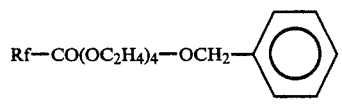 |
| 5 | 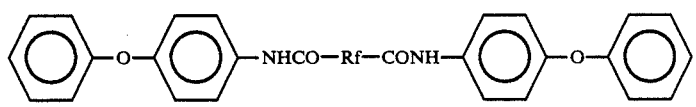 |
| 6 | 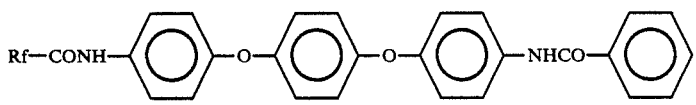 |
| 7 | 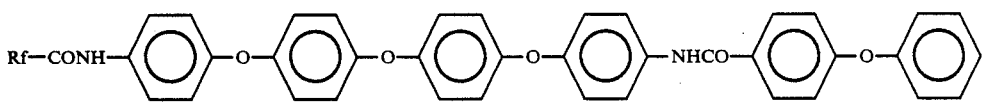 |
| 8 | 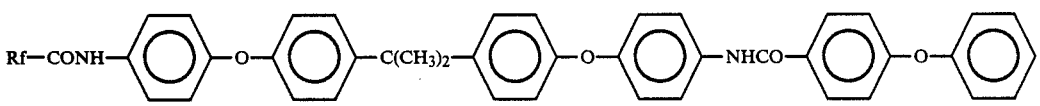 |

The photoreceptor shown in FIG. 1 has a conductive substrate 1, a charge generating layer 2, a charge transport layer 3, and a layer 4 near the surface of the charge transport layer composed of a material in which perfluoropolyoxyalkyl groups or perfluoropolyoxyalkylene groups are bonded to groups which do not contain fluorine.

More specifically, the charge generating layer 2 is formed on the conductive substrate 1, and an organic photoconductive layer 5 having a charge transport layer 3 is formed on the charge generating layer 2. The layer 4 formed on the charge transport layer 3 contains an organic lubricant 6 which is one of the bonds of perfluoropolyoxyalkyl groups or perfluoropolyoxyalkyl groups and groups containing no fluorine as shown in Table 1.

Table 2 shows values of solubility parameter of the lubricant which are shown in Table 1. The organic lubricant 6 has elements each having a portion 7 embedded in the charge transport layer 3 while the remainder portion 8 is exposed, as schematically shown in FIG. 8. The exposed portions 8 of the elements of the lubricant 6 densely and closely stand together from the surface of the charge transport layer so as to provide a lubrication layer.

where, $R_f$ represents $F(C_3F_6—O)_x\ C_2F_4$or $(C_2F_4—O)_y\ (CF_2—O)_z\ CF_2—$, while x, y and z are 14, 10 and 15, respectively, as means values.

TABLE 2

| Lubricant No. | Solubility parameter $(cal/cm^3)^{\frac{1}{2}}$ Organic groups | Fluorine groups |
|---|---|---|
| 1 | 11.1 | 7.1 |
| 2 | 11.4 | |
| 3 | 12.4 | |
| 4 | 10.2 | |
| 5 | 13.3 | |
| 6 | 13.8 | |
| 7 | 13.3 | |
| 8 | 12.7 | |

Figure 2:
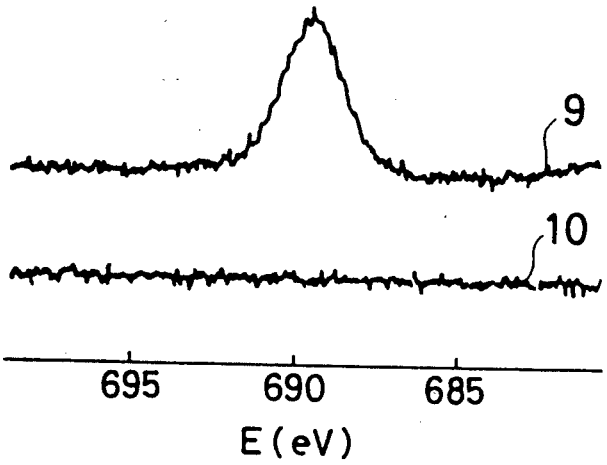
FIG. 2 is a spectrum illustrating the result of measurement of fluorine content originated in a lubricant.

FIG. 2 is a spectrum showing the result of measurement of fluorine content which is influenced by the provision of the organic lubricant. In this Figure, the axis of abscissa represents bound energy (eV). The analysis was conducted by means of an XPS (X-ray Photoelectron Spectroscopy). A curve 9 shows the fluorine peak intensity in the surface region of the organic photoconductive layer containing the organic lubricant having the structure in which perfluoropolyoxyalkyl groups or perfluoropolyoxyalkylene groups are boded to groups which do not contain fluorine, while a curve 10 shows the fluorine peak intensity as measured in the region which is 5 nm deep from the surface of the organic photoconductive layer.

Table 3 shows the fluorine coverage of the organic photoconductive layer containing the organic lubricant, in terms of prevent to the coverage provided by PTFE.

TABLE 3

| | Angle of contact with water (deg.) | Fluorine Coverage (%) *1 |
|---|---|---|
| Tefron | 108 | 100 |
| Organic photoconductive layer used in Invention | 105 | 95 |

*1: Coverage as obtained with 100% tefron and 0% binder.

Examples of the invention will be described hereinafter. It is to be understood, however, the invention is not limited to these Examples.

EXAMPLES 1 TO 8

A charge generating layer was formed on an aluminum plate of 100μm thick by applying a liquid having a composition as shown in Table 4 and then drying the applied liquid. The charge generating layer had a thickness of 1 μm or smaller.

Then, a charge transport layer is formed by applying through dipping a coated liquid of a composition as shown in Table 5 and then drying the liquid at 110° C.

TABLE 4

| Materials (Commercial Name) | Contents (g) | Manufacturer |
|---|---|---|
| τ-form metal-free phthalocyanine | 20 | Toyo Ink Mfg. Co., Ltd. |
| Tetrahydrofuran | 85 | Wako Pure Chemical Industries, Ltd. |
| Silane coupling agent (KP322) | 0.0005 | Shinetsu Chemicals Co., Ltd. |
| Silicone resin (KR255) | 13 | Shinetsu Chemicals Co., Ltd. |

The charge transport layer thus formed had a thickness of 15μm. As the coating material, a polyester-carbonate copolymer (MACRON KLI-1142) having a solubility parameter of 12.1 $(cal/cm^3)^{\frac{1}{2}}$ was used.

Electrophotographic characteristics of the photoreceptors thus obtained were measured by an electrostatic paper analyzer (manufactured by Kawaguchi Electric, SP-428). The residual potential was measured after 1.5-second illumination with a tungsten lamp (intensity 20 lux) and is expressed in terms of percent (%) to the potential before the illumination. The wear resistance was measured by rotating the photoreceptor at a peripheral speed of 34 m/min, pressing an urethane blade (manufactured by Toei Sangyo, hardness 73) at a line pressure of 200 g/cm to keep it in sliding contact with the photoreceptor for 20 seconds, and measuring the amount of reduction of thickness of the photoreceptor. The results are shown in Table 6.

TABLE 5

| Materials (Commercial Name) | Content (g) | Manufacturer |
|---|---|---|
| Oxazole compound (OX-2) | 8.0 | Japan Sensitizing Dyes Laboratories, Co., Ltd |
| Polyester-carbonate copolymer (MACRON KLI-1142) | 8.0 | Bayer, Japan |
| Methylene chloride | 84.0 | Wako Pure Chemical Industries, Ltd. |
| Silane coupling agent (KP322) | 0.016 | Chemicals Co., Ltd |
| Lubricant Nos. 1 to 8 (Table 1) | 0.008 | Hitachi, Ltd |

COMPARISON EXAMPLE 1

A charge generating layer was formed on an aluminum plate of 100 μm thick in the same manner as Examples 1 to 8, and was dried at 140° C. The thickness of the thus formed charge generating layer was 1 μm or smaller.

Then, a charge transport layer was formed by dipping, with a coating liquid having a composition shown in Table 7, containing no lubricant. After a drying at 110° C., the charge transport layer was obtained to have a thickness of 15 μm.

TABLE 6

| Examples | Lubricant | Thickness Reduction by Wear (μm) | Residual potential (%) |
|---|---|---|---|
| 1 | 1 | 0.3 | 7 |
| 2 | 2 | 0.2 | 6 |
| 3 | 3 | 0.0 | 7 |
| 4 | 4 | 0.2 | 7 |
| 5 | 5 | 0.0 | 7 |
| 6 | 6 | 0.0 | 6 |
| 7 | 7 | 0.0 | 6 |
| 7 | 7 | 0.0 | 6 |
| 8 | 8 | 0.0 | 7 |

The electrophotographic characteristics were measured by the same method as Examples 1 to 8, as well as wear-resistance and residual potential, the results being shown in Table 8.

It will be understood that Examples 1 to 8 of the photoreceptor of the present invention exhibits superior electrophotographic characteristics, as well as remarkably improved wear resistance. Thus, the present invention provides an excellent electrophotographic organic photoreceptor which can withstand a long repeated use.

TABLE 7

| Materials (Commercial Name) | Contents (g) | Manufacturer |
|---|---|---|
| Oxazole compound (OX-2) | 8.0 | Japan Sensitizing Dyes Laboratories, Co., Ltd |
| Polyester-carbonate copolymer (MACRON KLI-1142) | 8.0 | Bayer, Japan |
| Methylene chloride | 84.0 | Wako Pure Chemical Industries, Ltd |
| Silane coupling agent (KP322) | 0.016 | Shinetsu Chemical, Ltd |

TABLE 8

| Examples | Thickness Reduction by Wear (μm) | Residual potential (%) |
|---|---|---|
| 1 | 2.5 | 6 |

Comparison Example 2

Charge generating layer was formed in the same manner as Examples 1 to 8, and charge transport layer was formed by applying a coating liquid having a composition as shown in Table 9. The charge generating layer and the charge transport layer had thicknesses of 1 μm and 15 μm, respectively.

TABLE 9

| Materials (Commercial Name) | Contents (g) | Manufacturer |
|---|---|---|
| Oxazole compound (OX-2) | 8.0 | Japan Sensitizing Dyes Laboratories, Co., Ltd |
| Polyester-carbonate copolymer (MACRON KLI-1142) | 8.0 | Bayer, Japan |
| Methylene Chloride | 84.0 | Wako Pure Chemical Industries, Co., Ltd |
| Silane Coupling Agent (KP322) | 0.016 | Shinetsu Chemicals Co., Ltd |
| Lubricant Nos., 9 and 10 (Table 10) | 0.009 | Nippon Mectron Co., Ltd |

TABLE 10

| Lubricant Nos. | Molecular structure | organic groups | fluorine groups |
|---|---|---|---|
| 9 | Rf-$CH_2$—OH | 17.8 | |
| 10 | Rf-COOH | 15.2 | 7.1 |

Rf: perfluorooxyalkyl groups

Electrophotographic characteristics of the thus obtained photoreceptor were measured in the same manner as Comparison Example 1. The wear resistance was evaluated in terms of thickness reduction of the material when measured by rotating the photoreceptor at a peripheral speed of 34 m/min. The results are shown in Table 11.

TABLE 11

| Comparison Example | Lubricant | Thickness Reduction by Wear (μm) | Residual potential (%) |
|---|---|---|---|
| 2 | 9 | 3.5 | 6 |
| 2 | 10 | 2.5 | 6 |

It will be seen that Examples 1 to 8 of the electrophotographic organic photoreceptor of the present invention exhibit remarkably improved wear resistance, as well as superior electrophotographic characteristics, as compared with Example 2, thus proving superiority and capability to withstand a long repeated use.

EXAMPLES 9 TO 11

A charge generating layer having a thickness of 1 μm or smaller was formed on an aluminum plate of 100 μm. using each of liquids having compositions as shown in Table 4 as in the cases of Examples 1 to 8. Then, a coating liquid having a construction as shown in Table 12 was applied on the charge generating layer by dipping, and the liquid thus applied was dried at 110° C. so that a charge transport layer of 15 μm thick was obtained.

TABLE 12

| Materials (Commercial Name) | Contents (g) | Manufacturer |
|---|---|---|
| Oxazole compound (OX-2) | 8.0 | Japan Sensitizing Dyes Laboratories Co., Ltd |
| Polyester-carbonate copolymer (MACRON KLI-1142) | 8.0 | Bayer, Japan |
| Methylene Chloride | 84.0 | Wako Pure Chemicals Industries Co., Ltd |
| Silane Coupling Agent (KP322) | 0.016 | Shinetsu Chemicals Co., Ltd |

A 0.1 wt% solution of a fluorine-type lubricant of Table 13 was formed by dissolving this lubricant in a trifluorotrichloroethylene/methanol/water (90/9/0.2) solution. The aluminum plate having the charge transport layer was dipped in this solution and, after pulled out of the solution, dried at 120° C. for 10 minutes. After the heating, the layer thus formed was sufficiently washed with trifluorotrichloroethane and then dried again. A photoreceptor thus obtained had fluorine-type lubricant fixed by reaction on the surface of the charge transport layer. Electrophotographic characteristics of the thus obtained photoreceptor were measured in the same manner as Examples 1 to 8.

The residual potential was measured after 1.5-second illumination with a tungsten lamp (intensity 20 lux) and is expressed in terms of percent (%) to the potential before the illumination. The wear resistance was measured by rotating the photoreceptor at a peripheral speed of 34 m/min, pressing an urethane blade (manufactured by Toei Sangyo, hardness 73) at a line pressure of 200 g/cm to keep it in sliding contact with the photoreceptor for 20 seconds, and measuring the amount of reduction of thickness of the photoreceptor. The results are shown in Table 14.

TABLE 13

| Lubricant Nos. | Molecular Construction |
|---|---|
| 11 | Rf-CONH—$C_3H_6$—Si-(-$OC_2H_5$)$_3$ |
| 12 | Rf-$CH_2$—O—$C_3H_6$—Si-(-$OCH_3$)$_3$ |
| 13 | Rf-COO—$C_3H_6$—O—$C_3H_6$—Si—$OCH_3$)$_3$ |

Rf: perfluorooxyalkyl groups

TABLE 14

| Examples | Lubricant | Thickness Reduction by Wear (μm) | Residual potential (%) |
|---|---|---|---|
| 9 | 11 | 0.0 | 6 |
| 10 | 12 | 0.1 | 6 |
| 11 | 13 | 0.1 | 7 |

Thus, Examples 9–11 of the photoreceptor of the invention exhibits superior electrophotographic characteristics, as well as much improved wear resistance, as compared with Comparison Examples 1 and 2, thus proving superiority and capability of withstanding a long repeated use.

EXAMPLE 12

Figure 3:
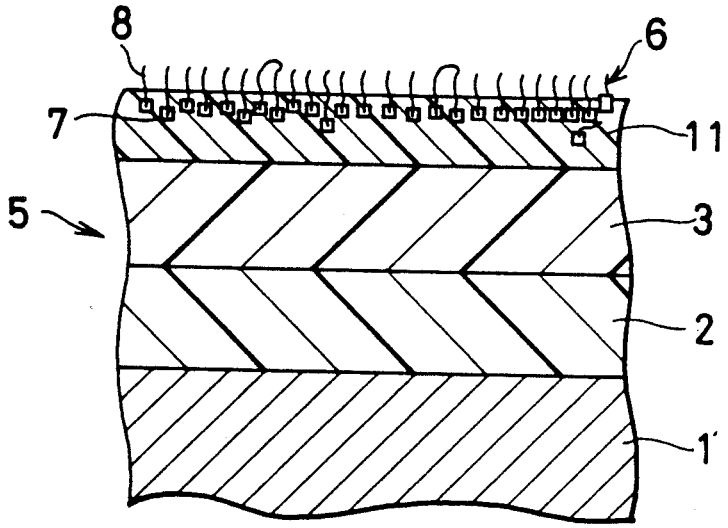
FIG. 3 is a schematic cross-sectional view of another embodiment of an electrophotographic photoreceptor of the present invention.

An electrophotographic photoreceptor was prepared by forming a charge generating layer and a charge transport layer in the same manner as Example 1. Then, a protective layer was formed by dipping the thus obtained electrophotographic photoreceptor in a coating liquid containing a lubricant as shown in Table 15 and then drying the coating liquid at 130° C. for 2 hours. The protective layer thus formed had a thickness of 2 μm. FIG. 3 shows in section the electrophotographic photoreceptor having the thus formed organic protective layer 11.

TABLE 15

| Materials (Commercial Name) | Contents (g) | Manufacturer |
|---|---|---|
| Melamine resin (MELAN27) | 10 | Hitachi Chemical Co., Ltd |
| Lubricant No. 8 | 0.006 | Hitachi, Ltd |
| Silane coupling agent (KP322) | 0.006 | Shinetsu Chemical Co., Ltd |
| n.butanol | 80 | Wako Pure Chemical Industries Co., Ltd |
| Methyl ethyl ketone | 10 | Wako Pure Chemcial Industries Co., Ltd |

Wear resistance and residual potential of the thus obtained electrophotographic photoreceptor were measured in the same manner as Examples 1 to 8. The thickness reduction was 0 μm, i.e., the wear was substantially zero. However, a large residual potential of 12% was observed as a result of provision of the protective layer.

Comparison Example 3

An electrophotographic photoreceptor was obtained by forming a charge generating layer and a charge transport layer in the same manner as Comparison Example 1. Then, a coating liquid having a composition materially the same as that shown in Table 15 except that the lubricant was omitted was applied to the electrophotographic material, followed by 2-hours drying at 130° C., so that a protective layer of 2 μm was obtained.

Wear resistance and residual potential were measured with this electrophotographic photoreceptor in the same manner as Examples 1 to 8. The thickness reduction due to wear was as small as 1.0 μm, while the residual potential was as high as 12%. It is therefore understood that the provision of the protective layer considerably reduces the wear but is still ineffective as compared with the provision of the protective layer which contains a lubricant.

Figure 4:
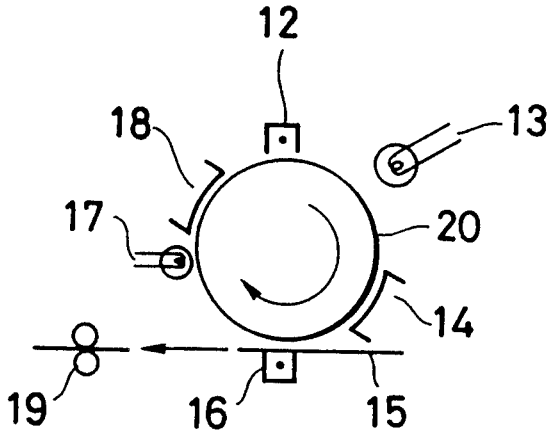
FIG. 4 is a schematic illustration of an electrophotographic apparatus in accordance with the present invention.

FIG. 4 shows an embodiment of the electrophotographic apparatus in accordance with the present invention. This electrophotographic apparatus can practically be realized as a copying machine, laser beam printer and so forth. The electrophotographic apparatus of the present invention makes use of a photoreceptor 20 containing the organic lubricant described hereinbefore. The electrophotographic process performed by this electrophotographic apparatus will be described hereinafter.

The photoreceptor 20 is used in the form of a drum 20 or a sheet which is wound on a suitable drum. One cycle of electrophotographic cycle is performed so that a single sheet of print is produced in one full rotation of the drum.

Electrostatic charges are imparted to the photoreceptor 20 by means of a corona charger 12. The charged portion of the photoreceptor 20 is then exposed to information to be recorded in a recording exposure section 13 so that an electrostatic latent image in the form of contrast between the zones having charges and the zones having no charge. The portion of the photoreceptor carrying the electrostatic latent image is then moved to a developing section 14 in which toner particles, which is a coloring agent and which is usually a mixture of carbon and a resin prepared in a particle size of 10 to 20 μm, is electrostatically deposited to the photoreceptor 20 thereby developing the electrostatic latent image. The portion of the photoreceptor 20 carrying the developed image is then moved to a section where a transfer corona charger 16 operates to transfer the toner image to a record paper 15. The paper 15 is then moved in the direction of an arrow past a fixing device 19 in which the image is fixed to the record paper, whereby a print is obtained.

Usually, the photoreceptor 20 in this type of apparatus is used repeatedly to produce 50,000 to 100,000 prints. After the transfer of the image to the recording paper, the photoreceptor moves through a charge removing exposure section 17 and a cleaner section 18 for removing residual toner, so as to be initialized for repeated use. Although in the illustrated arrangement the charge removing exposure section 17 is provided on the leading side of the cleaner section 18 as viewed in the direction of movement of the photoreceptor 20, this is not exclusive and the arrangement may be such that the charge removing exposure section is provided on the trailing side of the cleaner section 18.

As has been described, the present invention provides an electrophotographic photoreceptor which exhibits superior electrophotographic characteristics and high wear resistance by virtue of the lubricant as described hereinbefore, as well as an electrophotographic apparatus making use of such an electrophotographic photoreceptor.

What is claimed is:

1. An electrophotographic photoreceptor comprising:

a conductive substrate;

an organic photoconductive layer formed on said substrate and comprising a mixture of an organic photoconductive material and an organic polymer resin; and an organic lubricant of a fluorine compound, a portion of the compound being embedded in a surface region of said organic photoconductive layer and the remainder portion of the compound being exposed from the surface of said photoconductive layer, wherein the exposed portion has lubricating characteristics, and said fluorine compound is expressed by the following general formula:

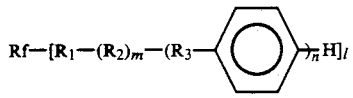

where Rf represents a fluorine-containing group having a skeleton composed of perfluoropolyoxyalkyl group or a perfluoropolyoxyalkylene group, $R_1$ represents a direct bond, —$CH_2$— group, —CO— group or —CONH— group, $R_2$ represents an oxyalkylene group having a carbon number of 2 or 3, $R_3$ represents a direct bond, —O— group, —COO— group, —CONH— group, —NHCO— group, —$OC_pH_{2p}$ group (p being an integer of 1 or 2), or —$C(CH_3)_2$— group, $R_3$ being changeable in each repetition, m represents O or positive integer, n represents an integer of one or more and l represents an integer of 1 or 2, said lubricant having a group soluble in the organic polymer of the photoconductive layer.

2. An electrophotographic photoreceptor according to claim 1, wherein said organic photoconductor layer is composed of a charge generating layer adjacent to said conductive substrate and a charge transport layer adjacent to said surface.

3. An electrophotographic photoreceptor according to claim 1, wherein a portion of said organic lubricant has organic groups the solubility parameter of which falls at least within the range of $\pm 2(cal/cm^3)^{\frac{1}{2}}$ with respect to the dissolution parameter of the material of said organic photoconductive layer while the remainder portion of said organic lubricant has a fluorine groups having a solubility parameter under $8(cal/cm^3)^{\frac{1}{2}}$.

4. An electrophotographic photoreceptor according to claim 1, wherein said material has the form of a drum or a sheet.

5. An electrophotographic photoreceptor according to claim 1, wherein a portion of said organic lubricant has organic groups the solubility parameter of which falls at least within the range of $\pm 2(cal/cm^3)^{\frac{1}{2}}$ with respect to the solubility parameter of the material of said organic photoconductive layer while the remainder portion of said organic lubricant has a fluorine groups having a solubility parameter under $8(cal/cm^3)^{\frac{1}{2}}$.

6. The electrophotographic photoreceptor according to claim 1, wherein the fluorine compound has the skeleton selected from the group consisting of the following groups:

$$F(C_3F_6-O)_x,\ F(C_3F_6-O)_xC_2F_4-,\ F[(C_3F_6-O)_x(CF_2-O)_y(CF_2)_2]$$

$$[(C_2F_4-O)_y\ (CF_2-O)_z\ (CF_2)]$$

where x, y and z each represents an integer of 1 or greater.

7. An electrophotographic photoreceptor comprising:

a conductive substrate;

an organic photoconductive layer formed on said substrate and comprising a mixture of an organic photoconductive material and an organic polymer resin; and an organic lubricant of a fluorine compound, a portion of the compound being embedded in a surface region of said organic photoconductive layer and the remainder portion of said compound being exposed from the surface of said photoconductive layer, wherein the exposed portion has lubricating characteristics, and said compound is expressed by the following general formula:

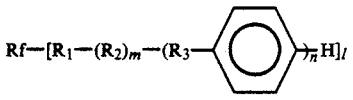

where Rf represents a fluorine-containing group having a skeleton composed of perfluoropolyoxyalkyl group or a perfluoropolyoxyalkylene group, $R_1$ represents a direct bond, $-CH_2-$ group, $-CO-$ group or $-CONH-$ group, $R_2$ represents an oxyalkylene group having a carbon number of 2 or 3, $R_3$ represents a direct bond, $-O-$ group, $-COO-$ group, $-CONH-$ group, $-NHCO-$ group, $-OC_pH_{2p}$ group (p being an integer of 1 or 2), or $-C(CH_3)_2-$ group, $R_3$ being changeable in each repetition, m represents O or positive integer, n represents an integer of one or more and l represents an integer of 1 or 2, said lubricant having a group soluble in the organic polymer of the photoconductive layer.

8. An electrophotographic photoreceptor according to claim 7, wherein said organic photoconductive layer is composed of a charge generating layer adjacent to said conductive carrier and a charge transport layer adjacent to said surface.

9. An electrophotographic photoreceptor according to claim 8, wherein said material has the form of a drum or a sheet.

10. The electrophotographic photoreceptor according to claim 8, wherein said fluorine compound has the skeleton selected from the group consisting of the following groups:

$$F(C_3F_6-O)_x,\ F(C_3F\ [_6-O)_x\ \ C_2F_4-,\ F\ [(C_3F_6-O)_x\ \ (CF\ _2-O)_y\ \ (CF_2)_z\ \ ]$$
$$\text{and } [C_2F_4-O)_y\ \ (CF_2-O)_z\ \ (CF_2)]$$

where x, y and z represent integers of 1 or greater.

11. A method of producing an electrophotographic photosensitive material comprising the steps of:

forming an organic mixture by mixing, with an organic photoconductive layer material, an organic lubricant which has a portion including groups soluble in said organic photoconductive layer material and the remainder portion including groups insoluble in said organic photoconductive layer material;

wherein said organic lubricant is expressed by the following general formula:

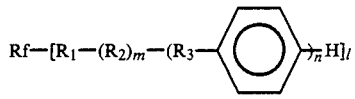

where Rf represents a fluorine-containing group having a skeleton composed of perfluoropolyoxyalkyl group or a perfluoropolyoxyalkylene group, $R_1$ represents a direct bond, $-CH_2-$ group, $-CO-$ group or $-CONH-$ group, $R_2$ represents an oxyalkylene group having a carbon number of 2 or 3, $R_3$ represents a direct bond, $-O-$ group, $-COO-$ group, $-CONH-$ group, $-NHCO-$ group, $-OC_pH_{2p}$ group (p being an integer of 1 to 2), or $-C(CH_3)_2-$ group, $R_3$ being changable in each repetition, m represents O or positive integer, n represents an integer of one or more and l represents an integer of 1 or 2, said lubricant having a group soluble in the organic polymer of the photoconductive layer;

coating a conductive substrate with said organic mixture;

and drying the coating layer so that said organic lubricant is fixed on the surface of said organic photosensitive layer such that said groups soluble in said organic photosensitive layer material are light-exposed on the surface of said organic photoconductive layer while said groups soluble in said organic photosensitive layer material are embedded in the surface region of said organic photoconductive layer.

12. An electrophotographic apparatus comprising:

an electrophotographic photoreceptor including a conductive substrate, an organic photoconductive layer formed on said conductive substrate, and an organic lubricant a portion of which embedded in or fixed by chemical reaction to the surface region of said organic photoconductive layer while the remainder portion is exposed from the surface of said photoconductive layer, wherein at least the exposed remainder portion having a lubricating characteristics so as to provide a lubricant layer;

a corona discharging part to charge said photosensitive material;

an light exposing part in which said photosensitive material is exposed to information to be recorded thereby forming an electrostatic latent image;

a developing part in which a toner is electrostatically deposited to said photosensitive material thereby developing the recorded image;

a transfer part in which said toner image is transferred to a recording paper;

a fixing part in which the transferred toner image is fixed;

a charge-removing part in which charges are removed from said photosensitive material; and a cleaning part in which the residual toner is removed from said photosensitive material.

* * * * *